US006797115B2

(12) United States Patent
Klerelid et al.

(10) Patent No.: US 6,797,115 B2
(45) Date of Patent: Sep. 28, 2004

(54) METHOD AND APPARATUS FOR MAKING A CREPED TISSUE WITH IMPROVED TACTILE QUALITIES WHILE IMPROVING HANDLING OF THE WEB

(75) Inventors: Ingvar Berndt Erik Klerelid, Karlstad (SE); Johan Ulf Rågård, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 10/375,824

(22) Filed: Feb. 26, 2003

(65) Prior Publication Data

US 2003/0221807 A1 Dec. 4, 2003

Related U.S. Application Data

(60) Provisional application No. 60/369,018, filed on Mar. 29, 2002.

(51) Int. Cl.[7] ..... B31F 1/12

(52) U.S. Cl. ..... 162/111; 162/193; 162/205; 162/280; 162/283; 162/361; 162/363; 162/114; 34/114; 241/160.1; 241/370

(58) Field of Search ..... 162/111, 118, 162/280–283, 204–206, 359.1, 361, 367–368, 363; 34/114, 534; 242/160.1, 370

(56) References Cited

U.S. PATENT DOCUMENTS

| | | | | | |
|---|---|---|---|---|---|
| 3,072,522 | A | | 1/1963 | Hornbostel | |
| 4,087,319 | A | | 5/1978 | Linkletter | |
| 4,179,330 | A | | 12/1979 | Page | |
| 4,692,215 | A | | 9/1987 | Kerttula | |
| 5,037,509 | A | | 8/1991 | Wedel | |
| 5,512,139 | A | * | 4/1996 | Worcester | 162/111 |
| 5,591,309 | A | | 1/1997 | Rugowski et al. | |
| 5,593,545 | A | | 1/1997 | Rugowski et al. | |
| 5,746,887 | A | * | 5/1998 | Wendt et al. | 162/109 |
| 5,759,346 | A | | 6/1998 | Vinson | |
| 5,888,347 | A | * | 3/1999 | Engel et al. | 162/117 |
| 6,183,601 | B1 | | 2/2001 | Otto et al. | |
| 6,187,140 | B1 | | 2/2001 | Anderson et al. | |
| 6,207,734 | B1 | | 3/2001 | Vinson et al. | |
| 6,228,220 | B1 | * | 5/2001 | Hada et al. | 162/203 |
| 6,524,445 | B1 | * | 2/2003 | Otto et al. | 162/361 |
| 6,551,461 | B2 | * | 4/2003 | Hermans et al. | 162/207 |
| 6,558,514 | B2 | * | 5/2003 | Rouhiainen et al. | 162/193 |
| 6,585,858 | B1 | | 7/2003 | Otto et al. | |
| 2002/0060036 | A1 | * | 5/2002 | Linden | 162/283 |
| 2002/0074684 | A1 | * | 6/2002 | Baggot et al. | 264/132 |
| 2002/0092637 | A1 | * | 7/2002 | Rouhiainen et al. | 162/272 |
| 2002/0179269 | A1 | * | 12/2002 | Klerelid | 162/206 |
| 2003/0111199 | A1 | | 6/2003 | Clarke et al. | |
| 2003/0116296 | A1 | | 6/2003 | Lin et al. | |
| 2003/0221807 | A1 | * | 12/2003 | Klerelid et al. | 162/111 |
| 2003/0226279 | A1 | * | 12/2003 | Klerelid et al. | 34/444 |
| 2003/0228444 | A1 | * | 12/2003 | Johnston et al. | 428/156 |

FOREIGN PATENT DOCUMENTS

| | | |
|---|---|---|
| DE | 303522 | 2/1918 |
| DE | 485191 | 11/1929 |
| WO | WO 00/19013 | 4/2000 |
| WO | WO 03/054296 A1 | 7/2003 |

OTHER PUBLICATIONS

International Search Report for PCT Application PCT/SE03/00376, completed Jun. 3, 2003 (date mailed Jun. 16, 2003).

* cited by examiner

*Primary Examiner*—José A. Fortuna
(74) *Attorney, Agent, or Firm*—Alston & Bird LLP

(57) ABSTRACT

A creped tissue paper is made by creping a tissue paper from a drying cylinder with a creping doctor, receiving the creped web on a carrying fabric, carrying the creped web on the carrying fabric through a compression nip that compresses the web to substantially reduce its thickness and improve softness of the web, and carrying the creped, compressed web on the carrying fabric or a subsequent fabric to a reel-up.

44 Claims, 12 Drawing Sheets

METHOD AND APPARATUS FOR MAKING A CREPED TISSUE WITH IMPROVED TACTILE QUALITIES WHILE IMPROVING HANDLING OF THE WEB

CROSS-REFERENCE TO RELATED APPLICATION

This application claims the benefit of the filing date of U.S. Provisional Patent Application Ser. No. 60/369,018 filed Mar. 29, 2002, the disclosure of which is incorporated herein by reference.

FIELD OF THE INVENTION

The invention relates to papermaking machinery and methods. The invention relates more particularly to the manufacture of creped tissue paper.

BACKGROUND OF THE INVENTION

In the production of tissue for use in personal hygiene products and the like, it is desired to produce a tissue with good tactile qualities (i.e., soft to the touch) while also achieving a high machine speed and efficiency. The speed and efficiency are often limited by the performance of the dry end of the machine between the final dryer and the winding station or reel-up. Tissue is extremely delicate and difficult to handle, especially at high machine speeds. Generally, improving the tactile qualities of tissue has been achieved by reducing the basis weight and the tensile strength of the web. Lower tensile strength translates into improved softness. Unfortunately, the reductions in basis weight and tensile strength have made it more difficult to achieve high machine speeds because of the difficulty of handling and controlling the weak web in the dry end from the creping doctor to the reel-up.

It would be desirable to provide a method of making a creped tissue paper providing improved tactile qualities while improving the handling and control of the web in the dry end.

SUMMARY OF THE INVENTION

The above needs are met and other advantages are achieved by the present invention, which provides a method and apparatus for making a creped tissue that leads to improved tactile qualities of the paper and also facilitates handling and control of the web in the dry end. An apparatus in accordance with the invention comprises a heated drying cylinder on which a tissue paper is dried, a creping doctor for creping the tissue paper from the drying cylinder so as to form a creped tissue paper, at least one carrying fabric spaced downstream of the creping doctor and forming an endless loop about a plurality of guide rolls, a web support extending from proximate the creping doctor to the carrying fabric and supporting and carrying the creped tissue paper thereon, and a reel-up for winding the creped tissue paper onto a building paper roll in the reel-up, the carrying fabric being urged against the building paper roll so as to wind the web thereon.

In some embodiments of the invention, the apparatus includes at least one compression device for compressing the web on the carrying fabric such that the web is substantially reduced in thickness and is improved in surface softness.

A method in accordance with the invention includes steps of creping a tissue paper from a heated drying cylinder, using a web support to guide the web from the creping doctor onto a carrying fabric, carrying the web on the carrying fabric up to the reel-up, and winding the web onto a building paper roll in the reel-up.

In some method embodiments of the invention, there is a further step of transporting the web on the carrying fabric through a compression device where the creped web is compressed to substantially reduce its thickness and improve its surface softness.

In some embodiments of the invention, the carrying fabric and web pass through a compression nip formed between two opposed rolls; optionally, the web can be sandwiched between the carrying fabric and another fabric when it passes through the compression nip. In other embodiments, a first carrying fabric supporting the web forms a nip with a first roll arranged to contact one side of the web to perform a one-sided calendering of the web. The web is then transferred from the first carrying fabric onto a second carrying fabric that forms a nip with a second roll arranged to contact the opposite side of the web to perform calendering on the opposite side of the web.

The compression of the creped web has been found to significantly improve the tactile quality of creped tissue, and in particular gives the tissue a silky feel. By guiding the tissue paper on the web support and then carrying the web on the supporting fabric all the way from the creping doctor to the reel-up, the stability problems associated with open draws are avoided, and the resulting improved web handling ability facilitates high machine speeds.

The compression roll(s) can be room temperature or heated. Preferably, the (or each) carrying fabric is permeable and one or more suction devices (e.g., blow boxes) are arranged within the loop of the/each carrying fabric.

In some embodiments, the web support that guides the web from the creping doctor onto the carrying fabric comprises an air foil. Preferably, the air foil is an active air foil. In other embodiments, the web support comprises another fabric. The other fabric preferably is permeable and a suction device preferably is disposed within the loop of the fabric to ensure that the web adheres to the fabric. The other fabric can pass through the compression nip such that, as previously noted, the web is sandwiched between the two fabrics when it passes through the nip; alternatively, the two fabrics can be arranged in sequence such that the web is transferred from one to another, and each fabric can form a compression nip with a roll as previously noted.

The peripheral speed of the paper roll in the reel-up preferably is greater than the speed of the carrying fabric that carries the web to the reel-up, so that slack in the web is avoided during the reeling.

When a compression roll contacts the web on a carrying fabric, the roll preferably is operated at a peripheral speed less than the speed of the fabric. In this manner, the roll creates slack in the web upstream of the roll and reduces slack in the web downstream of the roll.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
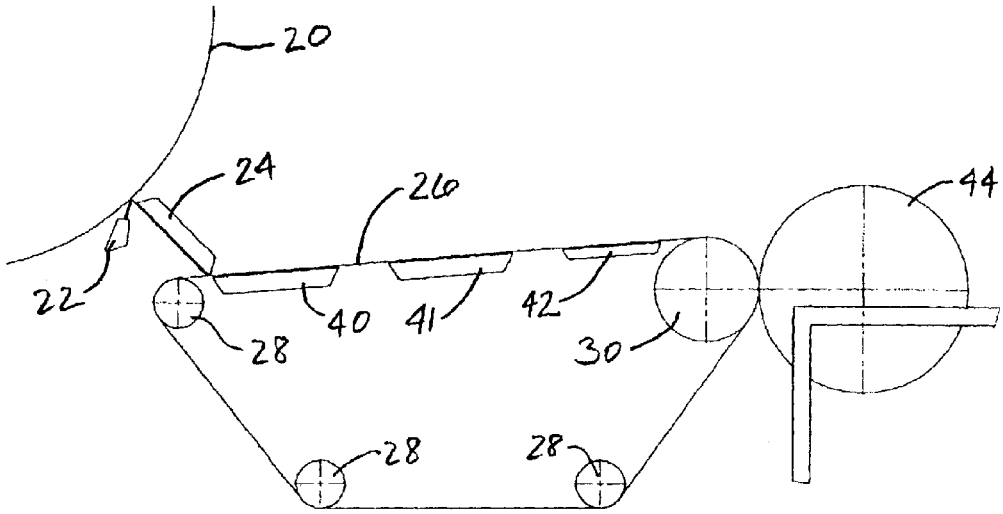
FIG. 1 is a diagrammatic depiction of a dry end of a paper machine in accordance with one embodiment of the invention.

FIG. 1 shows a first embodiment of the invention. In a tissue machine, the moist tissue paper is finally dried on a heated drying cylinder such as a Yankee dryer 20 and is creped from the surface of the dryer by a creping doctor 22. The action of the creping doctor 22 causes the tissue paper to become wrinkled so as to increase its bulk. The creped web is guided and supported by an air foil 24 as the web departs the Yankee dryer. The air foil 24 can be a passive air foil, but preferably is an active air foil that discharges air along the web-facing surface of the air foil to help guide and stabilize the web.

The air foil 24 guides the creped tissue paper onto a traveling carrying fabric 26 that forms an endless loop about a plurality of guide rolls 28 and about a reeling drum 30 at a downstream end of the fabric loop. In the illustrated embodiment, the carrying fabric 26 is a permeable fabric. The fabric can be woven or non-woven, and can be made of various materials including composite material or metal (including a rolled sheet).

To ensure that the tissue paper remains adhered to the carrying fabric 26, one or more vacuum devices preferably are arranged within the loop of the carrying fabric 26 for exerting suction through the fabric on the web. Thus, a vacuum device 40 is disposed against the inward-facing surface of the carrying fabric 26 just downstream of the air foil 24, a second vacuum device 41 is disposed downstream of the first vacuum device, and a third vacuum device 42 is disposed just upstream of the reeling drum 30. The vacuum devices can be vacuum boxes or any other device that creates an underpressure, such as a device marketed by Metso Corporation under the trademark BLOWBOX, which creates an underpressure by blowing air to induce a Coanda effect.

The carrying fabric 26, as noted, loops about a reeling drum 30 for the reel-up. The reeling drum 30 with the fabric 26 looped thereabout forms a reeling nip with a building paper roll 44 wound on a reel spool (not shown) in the reel-up. Thus, the fabric 26 guides the creped and compressed tissue paper onto the building paper roll 44.

The carrying fabric, in this embodiment as well as subsequently described embodiments, preferably is a substantially smooth-surfaced fabric, by which is meant that the fabric surface that contacts the web does not create any embossed structure in the web for increasing an effective thickness of the web when the fabric is pressed against the paper roll 44 to wind the web onto the roll. To the contrary, the pressing of the web in the nip between the fabric and paper roll can result in a very slight reduction in web thickness. Further thickness reduction can be accomplished, if desired, by the addition of a compression device, as described below in connection with further embodiments of the invention.

Figure 2:
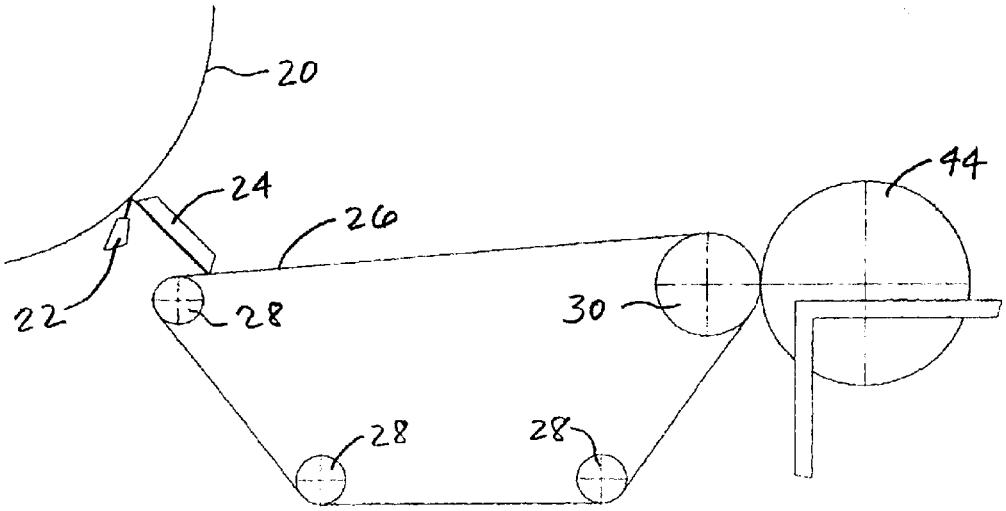
FIG. 2 depicts a dry end in accordance with a second embodiment of the invention.

FIG. 2 shows a second embodiment of a dry end in accordance with the invention. The embodiment of FIG. 2 is generally similar to that of FIG. 1, having a creping doctor 22, web support 24, carrying fabric 26, guide rolls 28, and reeling drum 30 arranged in the same fashion as indicated above. However, the fabric 26 in the embodiment of FIG. 2 is impermeable. Accordingly, the vacuum devices are omitted.

As noted, in some embodiments of the invention, the web after creping and prior to reeling is subjected to at least one compression operation to substantially reduce the caliper of the web. Thus, in the embodiment of FIG. 3, the apparatus is generally similar to that of FIG. 1, except a compression device is added. In the illustrated embodiment, the compression device is a press device having nip formed between a roll and a press member. More particularly, the press device comprises two rolls 32 and 34, the roll 32 being disposed within the loop of the fabric 26. Thus, the creped tissue paper is carried through the compression nip by the carrying fabric 26, and is compressed in the nip to significantly reduce the thickness of the web. The rolls 32 and 34 can be room temperature, or alternatively one or both of the rolls can be heated for heating the web in the nip. Preferably, one or more preferably both of the rolls 32, 34 can have a soft or deformable surface formed by a covering of rubber or the like. The rubber preferably has a hardness of about 15–70 P&J (i.e., hardness as measured by a Pusey & Jones plastometer, which measures the depth of depression, in hundredths of a millimeter, made by a ⅛"-diameter steel-ball under a constant load of one kilo at a temperature of seventy degrees Fahrenheit). It is also possible to use rolls without a soft covering (e.g., steel), the chief disadvantage being increased fabric wear caused by the high peak pressure in the nip.

Although a pair of rolls are illustrated for forming the compression device, it is also possible to use a press member and a roll forming an extended nip therebetween. For example, the press member can be a shoe roll or the like.

Preferably, the web thickness is reduced by about 20 to 50 percent by the compression device. The compression of the creped tissue paper substantially improves the tactile quality of the tissue, and in particular gives the tissue a silky surface texture. The tissue paper as reeled in the reel-up preferably has a basis weight of about 9 to 25 pounds per 3000 $ft^2$, a caliper of about 0.004 to 0.028 inch, a machine-direction (MD) tensile strength of about 150 to 800 g/in, and a cross-direction (CD) tensile strength of about 100 to 700 g/in.

The creped tissue paper, as shown, can be carried through the compression device while sandwiched between two fabrics. Thus, the dry end includes a second fabric 36 that forms an endless loop about the press roll 34 and about a plurality of guide rolls 38. The guide roll 38 at the downstream end of the second fabric loop is located upstream of the reeling drum 30. The second fabric 36 is permeable. The vacuum device 42 within the loop of the fabric 26 is located relative to the downstream guide roll 38 of the second fabric 36 so that the web is caused to follow the fabric 26 rather than the second fabric 36 when the two fabrics diverge.

Figure 3:
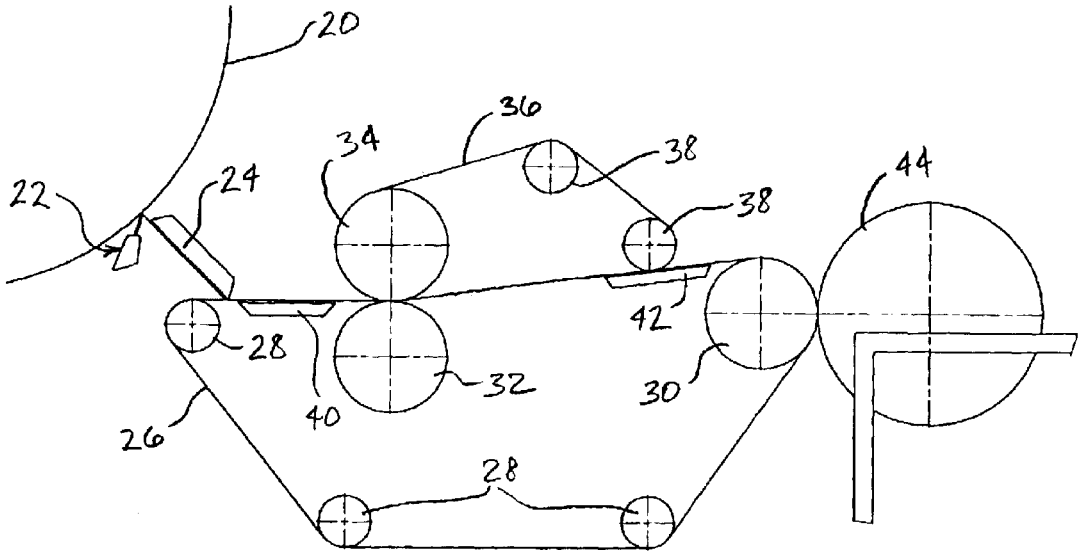
FIG. 3 depicts a dry end in accordance with a third embodiment of the invention.
Figure 4:
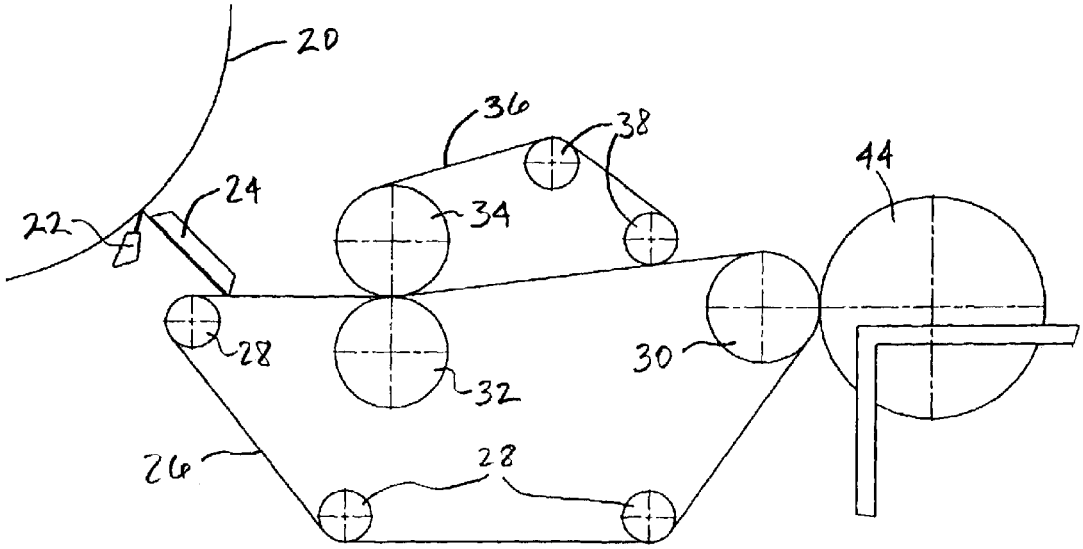
FIG. 4 depicts a dry end in accordance with a fourth embodiment of the invention.

FIG. 4 shows a fourth embodiment of the invention generally similar to that of FIG. 3, except that the carrying fabric 26 in the second embodiment is impermeable (and hence the vacuum devices are eliminated). The second fabric 36 again is permeable so that the creped, compressed tissue paper has a tendency to follow the impermeable fabric 26 when the two fabrics diverge at the downstream guide roll 38.

Figure 5:
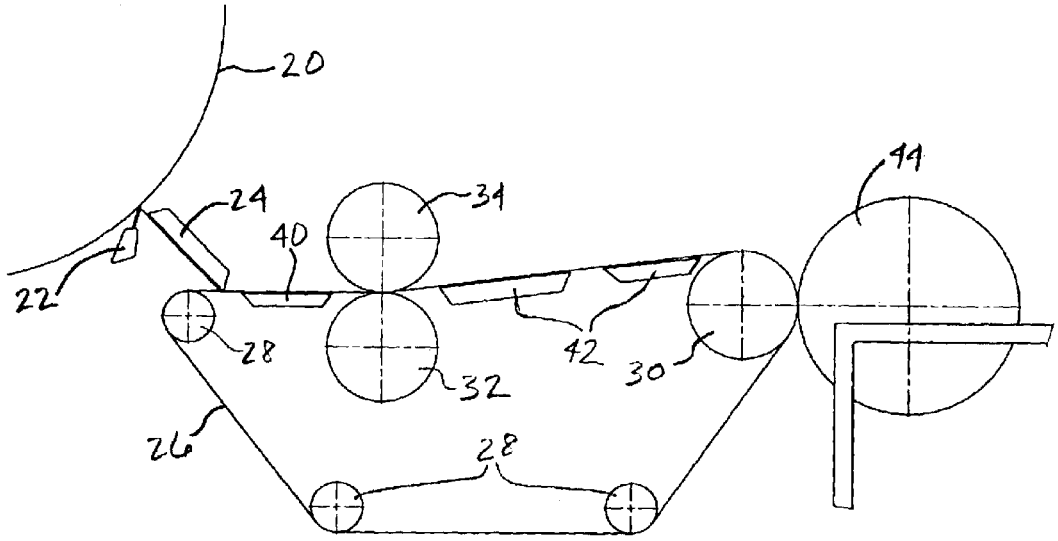
FIG. 5 depicts a dry end in accordance with a fifth embodiment of the invention.

FIG. 5 depicts a fifth embodiment of the invention in which the second fabric is omitted. The creped tissue paper is carried on the carrying fabric 26 through the compression nip between rolls 32 and 34 such that in the nip one surface of the web contacts the fabric 26 and the other surface contacts the roll 34. A vacuum device 40 is disposed within the loop of the fabric 26 just downstream of the air foil 24 to urge the tissue paper against the fabric and thereby ensure proper transfer of the web onto the fabric. The ensure that the creped, compressed tissue paper does not follow the roll 34 on exiting the nip, the surface of the fabric 26 can be smoother than the surface of the roll 34 (e.g., the roll surface can be textured); additionally, a vacuum device 42 just downstream of the nip exerts suction on the web to keep the web adhered to the fabric 26. As shown, there can be more than one vacuum device 42 in the portion of the fabric loop after the compression device.

Figure 6:
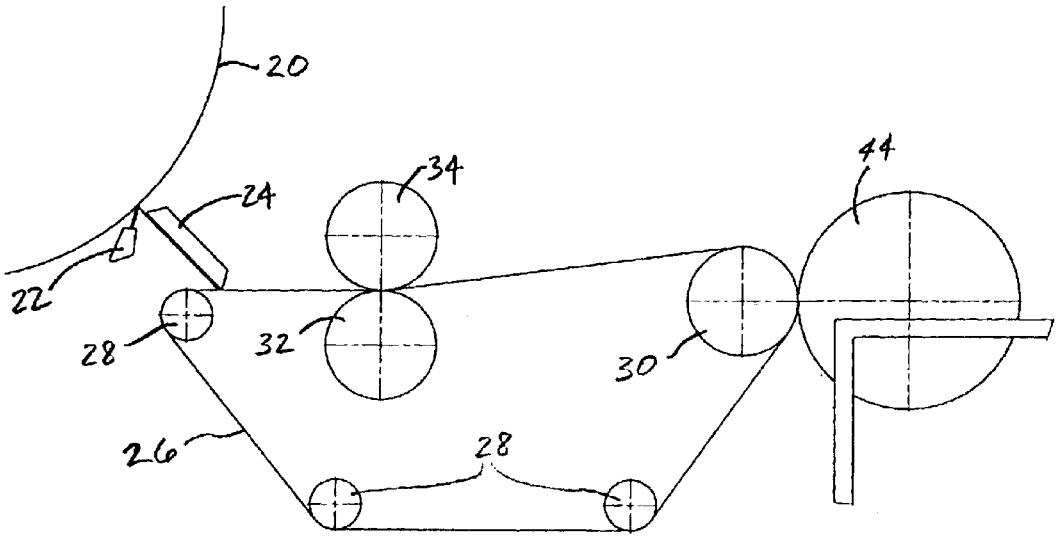
FIG. 6 depicts a dry end in accordance with a sixth embodiment of the invention.

FIG. 6 shows a sixth embodiment of the invention generally similar to that of FIG. 5 except that the fabric 26 of the sixth embodiment is impermeable (and hence the vacuum devices are omitted). To ensure that the web remains on the fabric 26 on exiting the nip, the surface of the fabric 26 can be made smoother than that of the roll 34.

Figure 7:
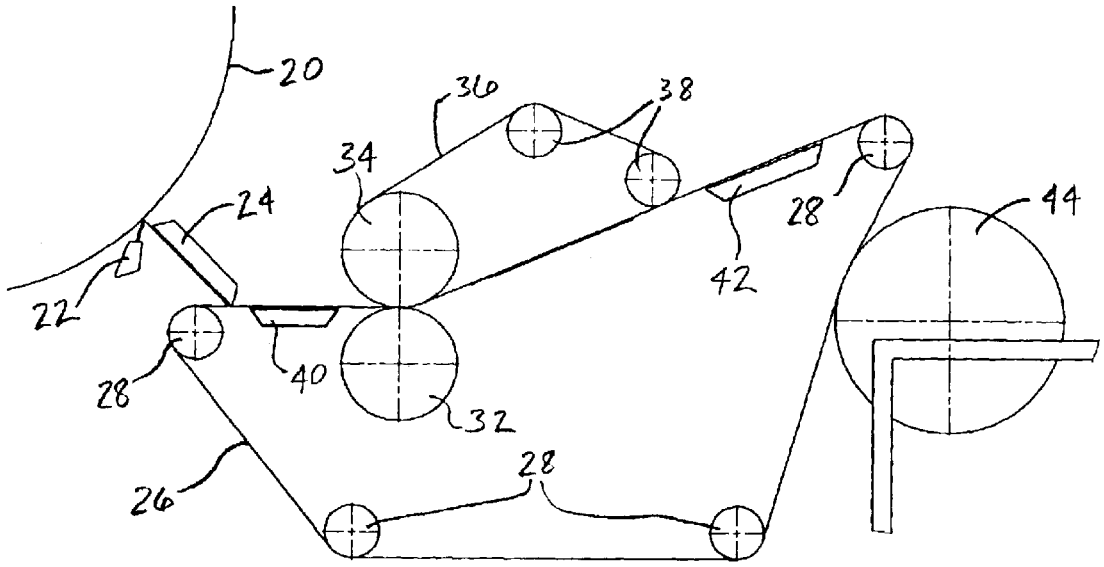
FIG. 7 depicts a dry end in accordance with a seventh embodiment of the invention.

FIG. 7 depicts a seventh embodiment of the invention generally similar to that of FIG. 3, except that in the reel-up the reeling is not performed against a reeling drum. Instead, the carrying fabric 26 alone forms a nip with the building paper roll 44. The loop of the fabric 26 after the compression nip extends generally diagonally upward to an upper guide roll 28 disposed generally above the building paper roll 44. A free-span portion of the fabric 26 extends from this upper guide roll 28 down to a lower guide roll 28, and this free-span portion of the fabric 26 forms a nip with the paper roll.

Figure 8:
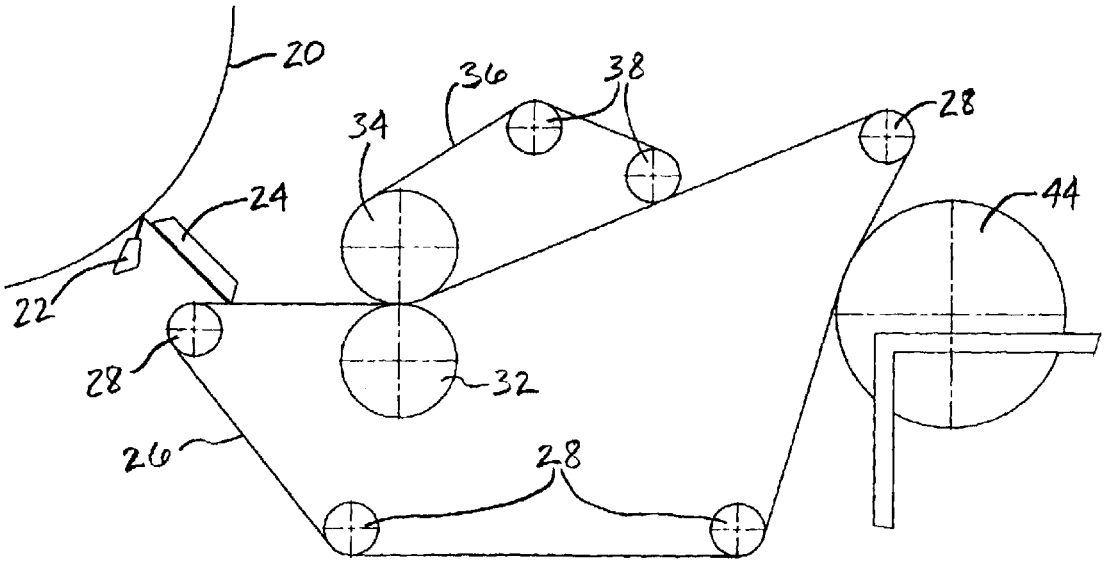
FIG. 8 depicts a dry end in accordance with an eighth embodiment of the invention.

The eighth embodiment of FIG. 8 is generally similar to that of FIG. 7, except that the fabric 26 is impermeable (and hence the vacuum devices 40 and 42 are eliminated). The second fabric 36 can be permeable or impermeable, but preferably is permeable so that the creped, compressed tissue paper has a tendency to follow the impermeable fabric 26 when the two fabrics diverge at the downstream guide roll 38.

Figure 9:
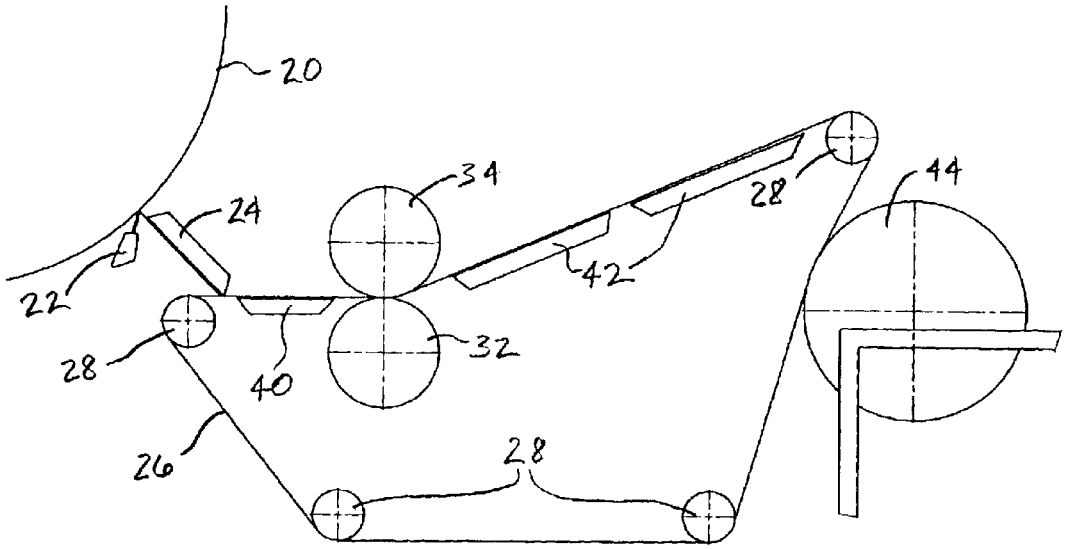
FIG. 9 depicts a dry end in accordance with a ninth embodiment of the invention.

FIG. 9 shows a ninth embodiment of the invention generally similar to that of FIG. 5, except that in the reel-up the reeling is not performed against a reeling drum. Instead, the carrying fabric 26 alone forms a nip with the building paper roll 44. The loop of the fabric 26 after the compression nip extends generally diagonally upward to an upper guide roll 28 disposed generally above the building paper roll 44. A free-span portion of the fabric 26 extends from this upper guide roll 28 down to a lower guide roll 28, and this free-span portion of the fabric 26 forms a nip with the paper roll.

Figure 10:
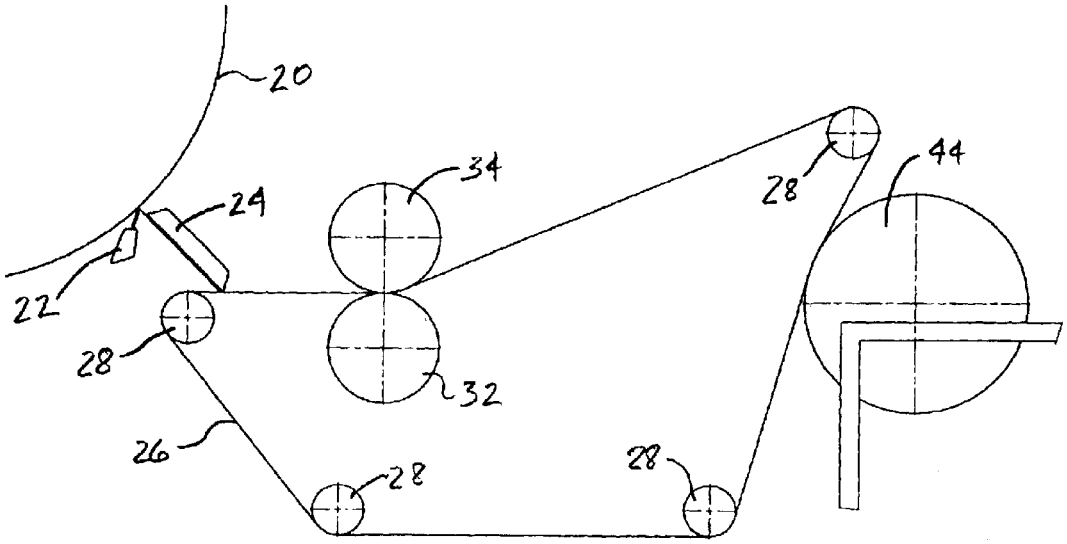
FIG. 10 depicts a dry end in accordance with a tenth embodiment of the invention.

FIG. 10 depicts a tenth embodiment of the invention generally similar to that of FIG. 9 except the carrying fabric 26 is impermeable (and hence the vacuum devices are omitted). To ensure that the web remains on the fabric 26 on exiting the nip, the surface of the fabric 26 can be made smoother than that of the roll 34.

Figure 11:
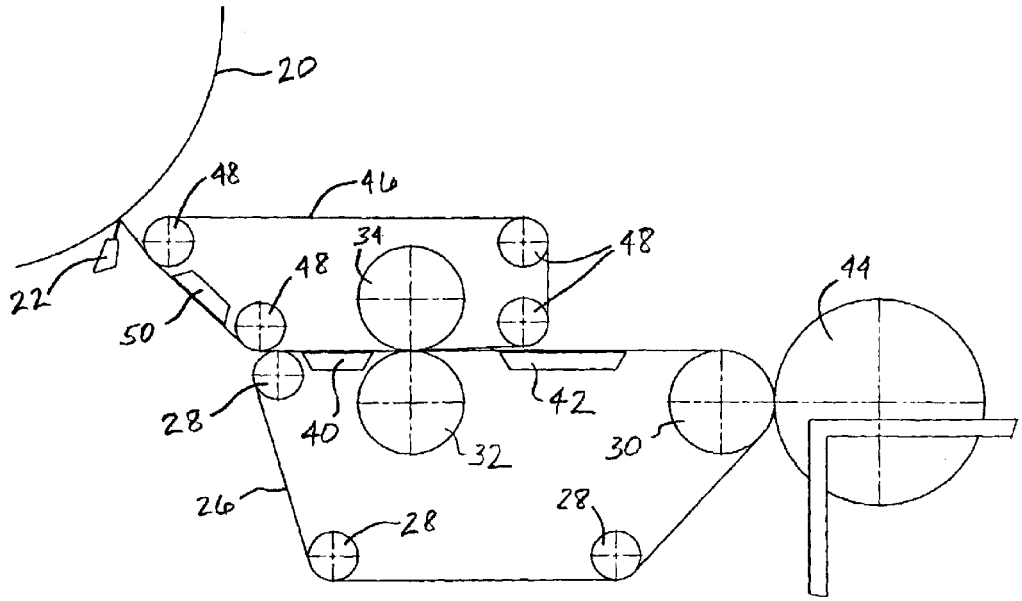
FIG. 11 depicts a dry end in accordance with an eleventh embodiment of the invention.

FIG. 11 shows an eleventh embodiment of the invention. In this embodiment, the web support that guides the web from the creping doctor 22 to the carrying fabric 26 comprises a second fabric 46 forming an endless loop about a plurality of guide rolls 48. The upstream-most guide roll 48 is adjacent the Yankee dryer 20 just downstream of the creping doctor 22. The web after being creped from the Yankee dryer is supported and carried by the fabric 46 onto the carrying fabric 26. The fabric 46 is permeable, and a vacuum device 50 arranged against the inward-facing surface of the fabric 46 just downstream of the upstream-most guide roll 48 suctions the creped web against the fabric to prevent the web from falling off the fabric. The upstream-most guide roll 48 can be a suction roll if desired, or a solid roll as shown. The fabric 46 passes through the compression nip between the rolls 32, 34 and the creped web is sandwiched between the two fabrics 26, 46 as they pass through the nip. The carrying fabric 26 is also permeable. A vacuum device 42 is arranged against the inward-facing surface of the fabric 26 downstream of the compression device to ensure the web follows the fabric 26 to the reel-up rather than adhering to and following the second fabric 46. Another vacuum device 40 is arranged against the inward-facing surface of the fabric 26 upstream of the compression device to ensure the transfer of the web from the fabric 46 onto the carrying fabric 26. Reeling is performed against the reeling drum 30 as in the embodiments of FIGS. 1–4.

Figure 12:
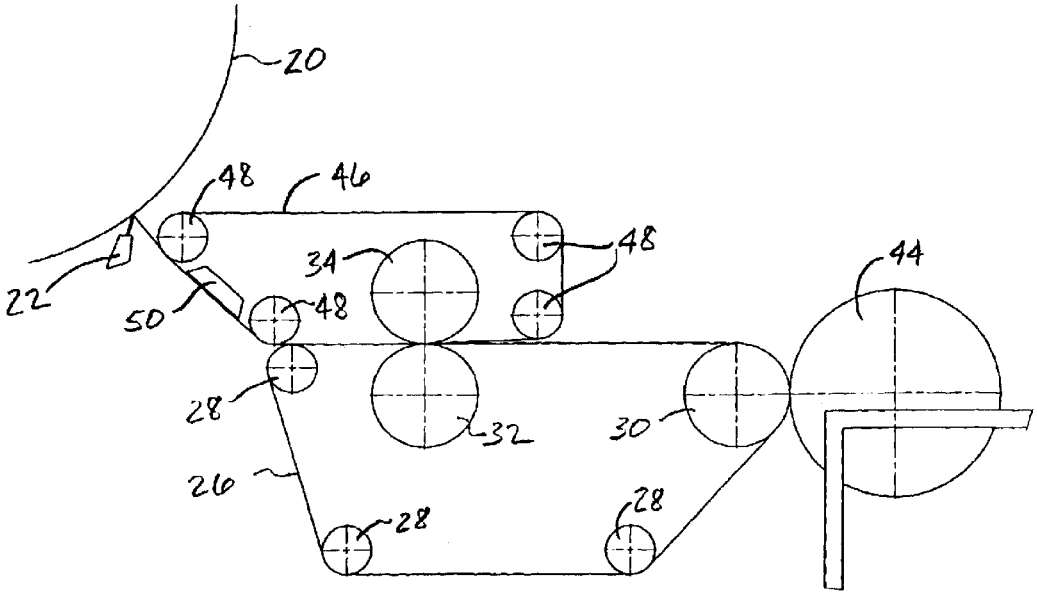
FIG. 12 depicts a dry end in accordance with a twelfth embodiment of the invention.

FIG. 12 depicts a twelfth embodiment of the invention generally similar to that of FIG. 11 except the carrying fabric 26 is impermeable (hence the vacuum devices 40, 42 are omitted). The creped, compressed tissue paper will tend to follow the impermeable carrying fabric 26 rather than the permeable fabric 46 on exiting the nip.

Figure 13:
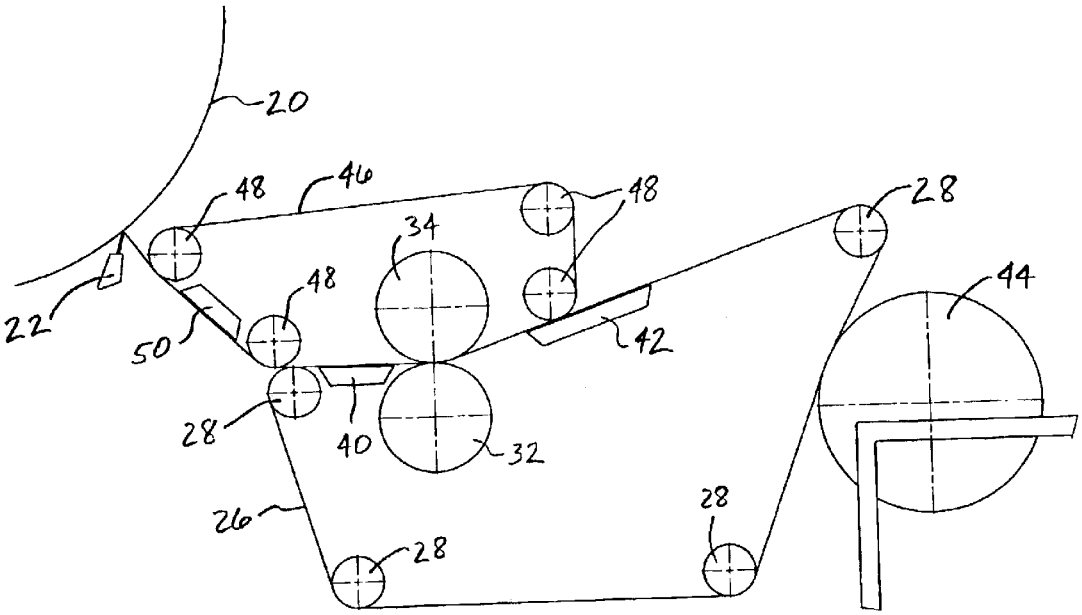
FIG. 13 shows a dry end in accordance with a thirteenth embodiment of the invention.

FIG. 13 shows a thirteenth embodiment of the invention generally similar to that of FIG. 11, except that in the reel-up the reeling is not performed against a reeling drum. Instead, the carrying fabric 26 alone forms a nip with the building paper roll 44. The loop of the fabric 26 after the compression nip extends generally diagonally upward to an upper guide roll 28 disposed generally above the building paper roll 44. A free-span portion of the fabric 26 extends from this upper guide roll 28 down to a lower guide roll 28, and this free-span portion of the fabric 26 forms a nip with the paper roll.

Figure 14:
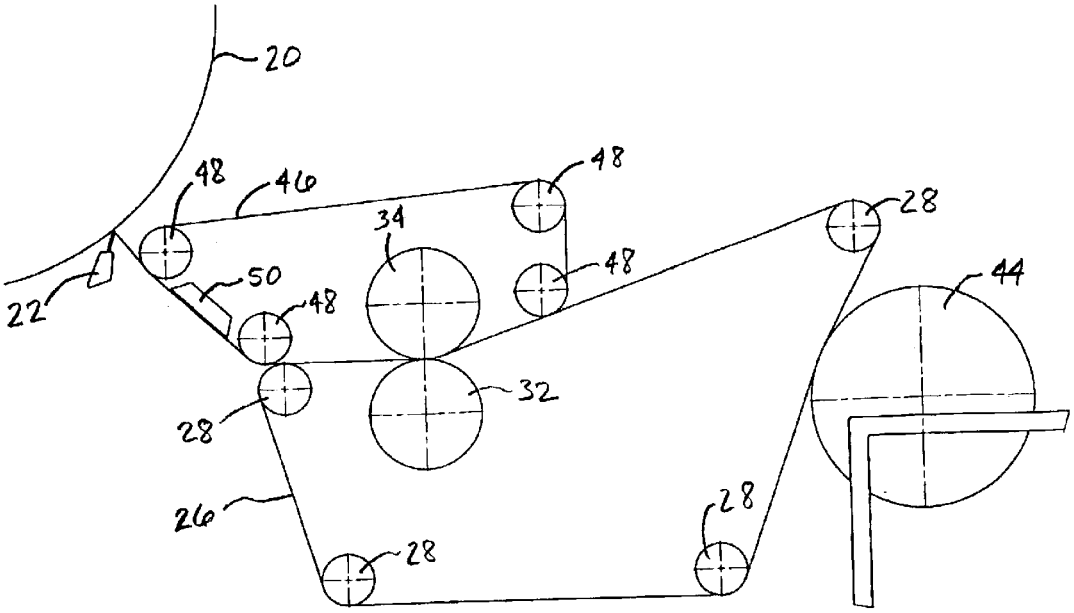
FIG. 14 shows a dry end in accordance with a fourteenth embodiment of the invention.

FIG. 14 depicts a fourteenth embodiment of the invention generally similar to that of FIG. 13, except the carrying fabric 26 is impermeable (hence the vacuum devices 40, 42 are omitted).

Figure 15:
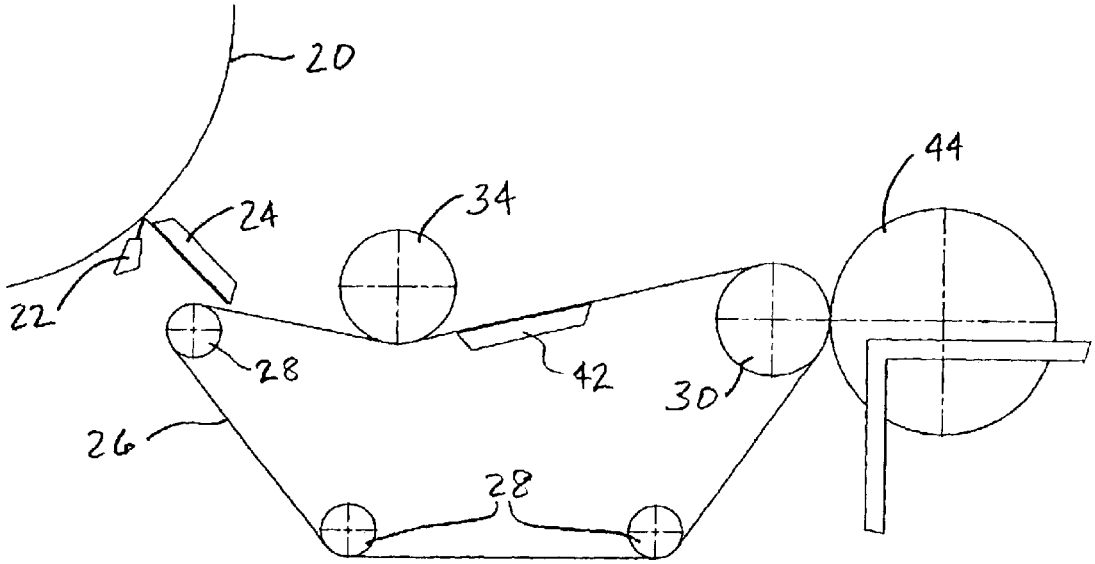
FIG. 15 depicts a dry end in accordance with a fifteenth embodiment of the invention.

FIG. 15 shows a fifteenth embodiment of the invention, in which a one-sided compression or calendering of the web is effected with a compression device of the belt-calender type. The web is creped from the drying cylinder 20 via a doctor blade 22 and is guided and supported by an air foil 24 onto a permeable fabric belt 26 arranged in an endless loop about a plurality of guide rolls 28, which belt carries the web about a reeling drum 30 forming a reeling nip with the building paper roll 44 in the reel-up, similar to the embodiment of FIG. 3. The compression device comprises a roll 34 that forms a calendering nip with the belt 26. The roll 34 contacts the web on the belt and compresses the web from one side thereof. The belt 26 wraps about the roll 34 for an angular sector in the range of about 0–90 degrees, and preferably wraps about the roll for an angular sector greater than zero degrees so as to form an extended nip. A vacuum device 42 is arranged in the loop of the belt 26 downstream of the compression device to keep the web adhered to the belt.

Figure 16:
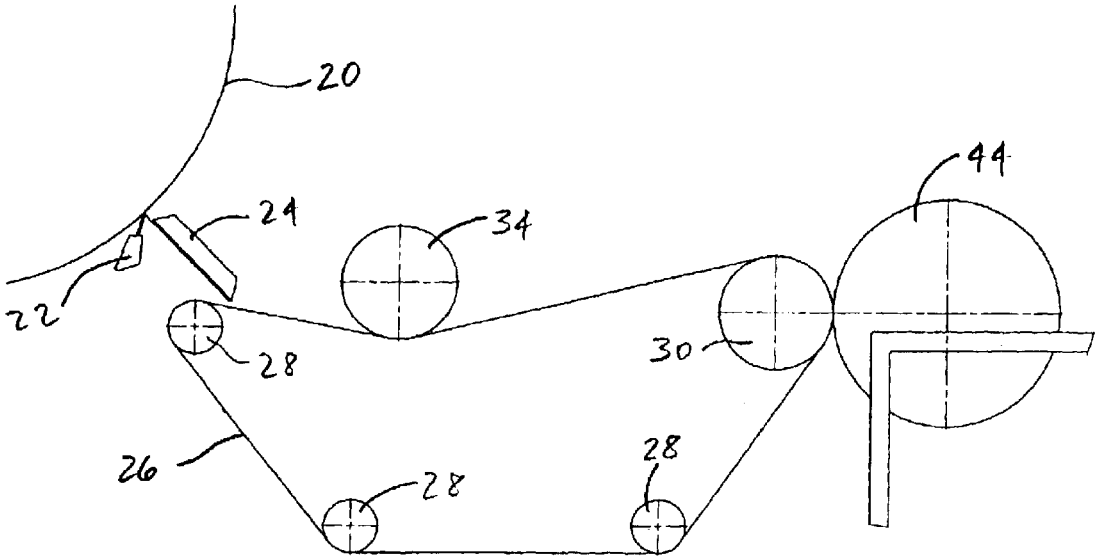
FIG. 16 depicts a dry end in accordance with a sixteenth embodiment of the invention.

FIG. 16 depicts a sixteenth embodiment of the invention, which is similar to that of FIG. 15, except the belt 26 is impermeable, and hence the vacuum device 42 is omitted.

Figure 17:
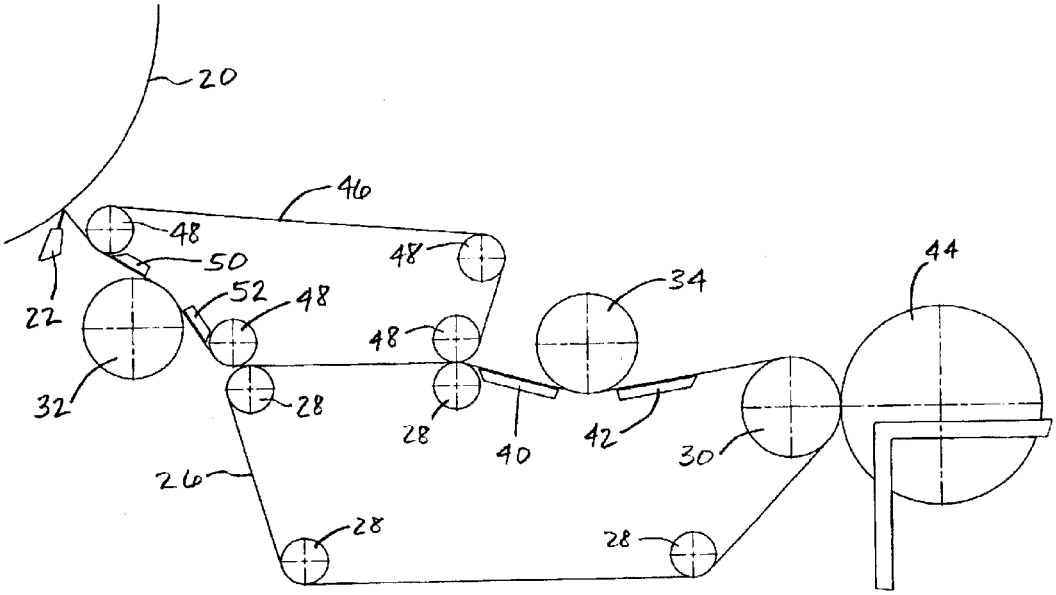
FIG. 17 shows a dry end in accordance with a seventeenth embodiment of the invention.

FIG. 17 illustrates a seventeenth embodiment of the invention, in which a two-sided compression or calendering of the web is effected with two compression devices of the belt-calendering type. The web is creped via doctor blade 22 from the drying cylinder 20 and traverses a short open draw to a web support in the form of a permeable belt 46 arranged in an endless loop about guide rolls 48. A vacuum device 50 is arranged in the loop of the belt 46 just downstream of the upstream-most guide roll 48 to ensure the web adheres to the belt 46. The web is subjected to a one-sided calendering via a roll 32 that contacts one side of the web (the lower side in the particular orientation of the web depicted in FIG. 17) and compresses the web against the belt 46. The belt 46 wraps about the roll 32 with a wrap angle in a range as previously noted in connection with FIG. 15, so as to form an extended compression nip. A vacuum device 52 is arranged in the loop of the belt 46 just downstream of the roll 32 to ensure the web follows the belt 46 after the compression nip. The belt 46 then carries the web onto a second permeable belt 26 arranged in a loop about guide rolls 28 and about reeling drum 30. The web is sandwiched between the belts 46 and 26 for some distance, and then the belt 46 diverges from the belt 26; a vacuum device 40 arranged just downstream of the point of divergence ensures that the web travels with the belt 26. The web is subjected to a second one-sided compression via a roll 34 that contacts the opposite side of the web (the upper side in the particular orientation of the web depicted in FIG. 17) and compresses the web against the belt 26. The belt 26 wraps about the rolls 34 with a wrap angle in the range previously noted in connection with FIG. 15, so as to form an extended compression nip. A vacuum device 42 is arranged in the loop of the belt 26 downstream of the roll 34 to ensure the web travels with the belt after the compression nip. The web is then carried into the reeling nip between reeling drum 30 and the building paper roll 44 in the reel-up, where the web is wound onto the paper roll.

Figure 18:
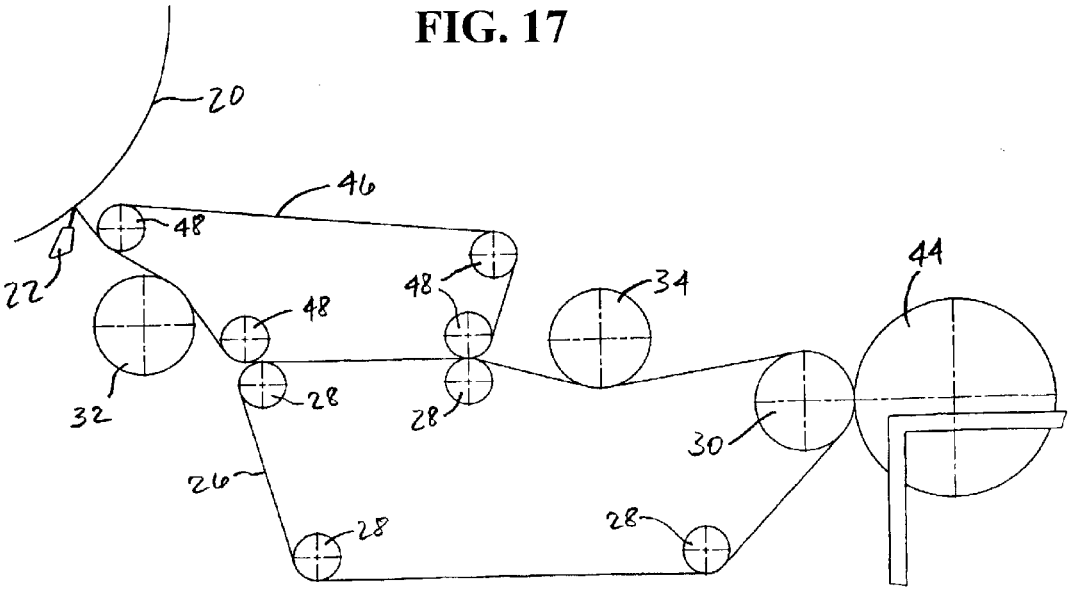
FIG. 18 illustrates a dry end in accordance with an eighteenth embodiment of the invention.

FIG. 18 shows an eighteenth embodiment of the invention, which is similar to that of FIG. 17 except the belts 26 and 46 are impermeable, and hence the vacuum devices 40, 42, 50, 52 are omitted.

The tactile quality imparted to the creped tissue in the compression nip(s) depends on various factors, including the surface characteristics of the fabric(s) in contact with the web through the nip(s), the linear nip load exerted in the nip(s), whether heating is carried out in the nip(s), and other factors.

The thickness of the web preferably is reduced by a substantial amount (e.g., 20 to 50 percent) as a result of the compression of the web in the compression nip(s). A consequence of the thickness reduction is a lengthening of the web in the machine direction, which creates slack in the web on the belt downstream of the nip. To avoid winding difficulties in the reel-up, the peripheral speed of the paper roll 44 preferably should exceed the speed of the belt 26 (which is equal to the peripheral speed of the reeling drum 30 in those embodiments employing a reeling drum) so that slack is removed from the web before the web is wound onto the paper roll. For instance, the peripheral speed of the paper roll 44 advantageously should be about 0–10% higher than the speed of the belt 26.

When the web is sandwiched between two belts (e.g., 26 and 36, or 26 and 46) and passed between two rolls (32 and 34), the two belts advantageously have the same speed, which is less than the peripheral speed of the paper roll 44 as noted above.

In contrast, when the web is subjected to a one-sided calendering in a belt calender formed between a roll and a belt (e.g., between roll 34 and belt 26, or between roll 32 and belt 46), it is believed to be beneficial for the peripheral speed of the roll to be less than the speed of the belt. In particular, it is believed such a speed relationship between the roll and belt improves tactile qualities of the web, reduces slack in the web downstream of the roll (and correspondingly creates slack upstream of the roll), and improves runnability of the web. For instance, the peripheral speed of the roll advantageously should be about 0–20% less than the speed of the belt.

Figure 19:
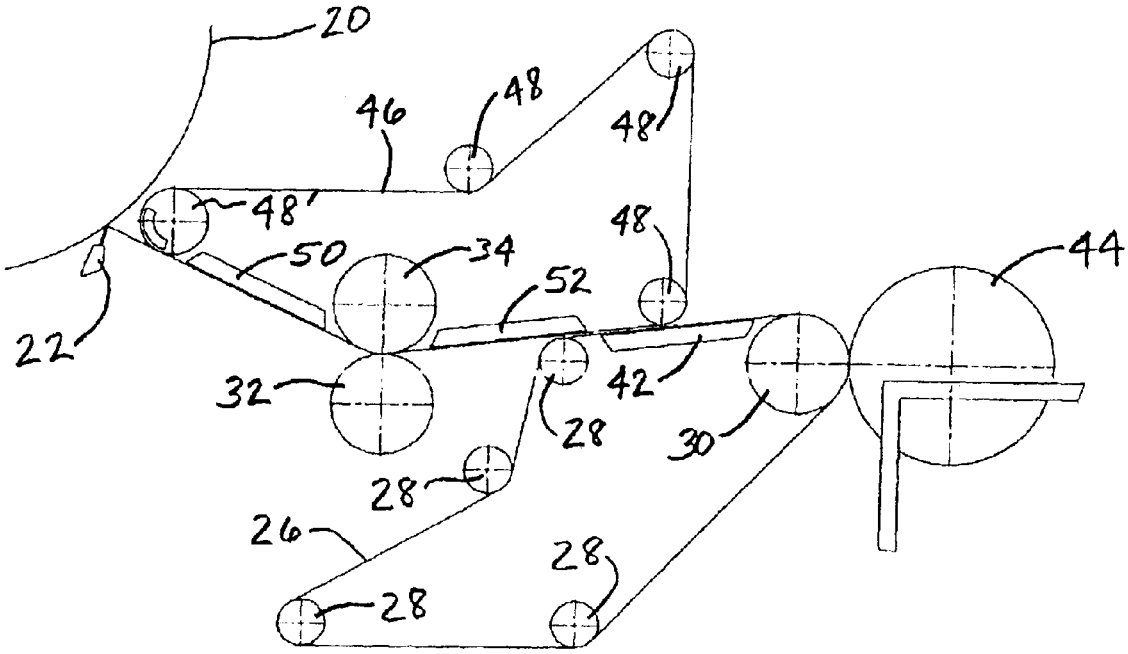
FIG. 19 depicts a dry end in accordance with a nineteenth embodiment of the invention.

FIG. 19 illustrates a nineteenth embodiment of the invention, which employs a somewhat different technique for taking out slack caused by the reduction in caliper of the web. The paper web is creped from the Yankee dryer 20 using the doctor blade 22. Located as close as possible to the Yankee dryer 20 is a suction pick-up roll 48' disposed within the loop of pervious fabric 46. The pick-up roll 48' ensures the transfer of the web from the Yankee dryer onto the fabric 46. Additionally, a suction box 50 located just after the pick-up roll ensures that the web adheres to the under surface of the fabric 46 up to a compression nip formed between a compression roll 34 disposed in the loop of the fabric 46 and a compression roll 32 located outside the loop of the fabric 46. The fabric 46 and the web pass through the compression nip. A suction box 52 is located in the loop of the fabric 46 downstream of the nip for ensuring the web remains on the fabric. A downstream portion of the loop of the fabric 46 is adjacent a second pervious fabric 26 that forms a loop guided by guide rolls 28. The fabric 26 also loops about reeling drum 30. The loop of fabric 26 can overlap with the loop of fabric 46 for a distance, as shown. A small gap (up to about 30 mm) is formed between the fabric 26 and the fabric 46 in the thickness direction of the web (i.e., normal to the web surface). As previously noted, the compression of the web in the compression nip, and the consequent reduction in caliper of the web, results in the web becoming longer in the machine direction after the nip. To take out the resultant slack and ensure proper winding of paper rolls in the reel-up, the second fabric 26 is operated at a higher speed than the first fabric 46. The small gap between the two fabrics is provided to avoid the web being destroyed by the speed differential. In this embodiment, the peripheral speed of the paper roll 44 can be the same as the speed of the fabric 26, or the peripheral speed of the paper roll 44 can be higher than the speed of the fabric 26. In one advantageous arrangement, the paper roll speed and the speed of the fabric 26 are both about 6% higher than the speed of the fabric 46 (which is equal to the peripheral speed of the compression rolls 32, 34).

Figure 20:
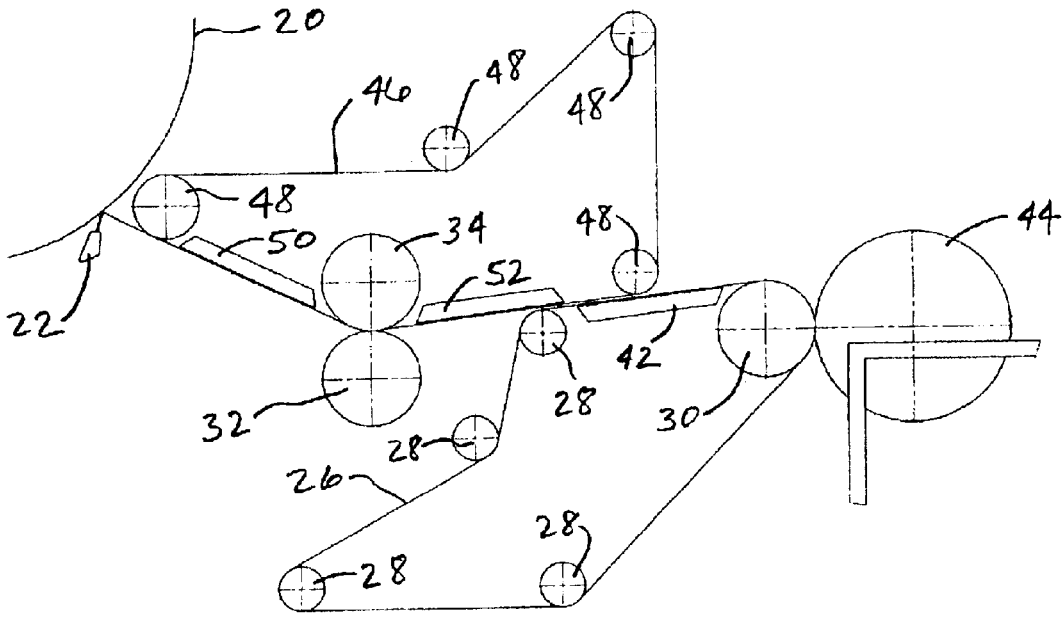
FIG. 20 shows a dry end in accordance with a twentieth embodiment of the invention.

FIG. 20 shows a twentieth embodiment of the invention, which is the same as the embodiment of FIG. 19 except that the pick-up roll 48 at the upstream end of the loop of fabric 46 is a solid pick-up roll rather than a suction pick-up roll.

Figure 21:
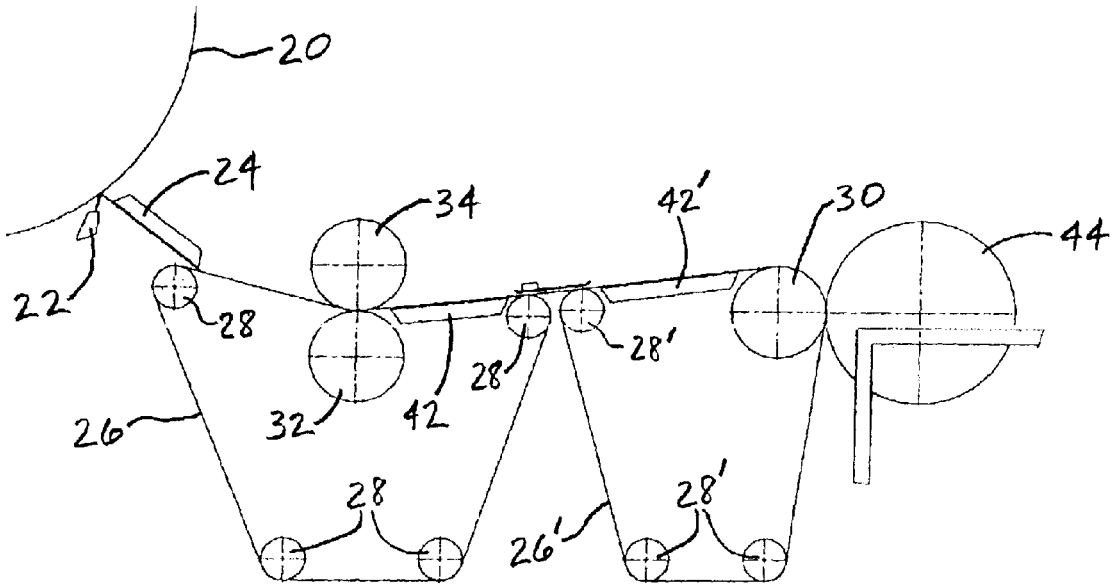
FIG. 21 illustrates a dry end in accordance with a twenty-first embodiment of the invention.

FIG. 21 depicts a twenty-first embodiment of the invention, similar in many respects to that of FIG. 5 except the loop of the pervious fabric 26 downstream of the compression nip terminates and the web is then transferred from the fabric 26 onto a second pervious fabric 26' arranged in a loop about guide rolls 28' and about reeling drum 30. The distance in the machine direction between the end of the fabric loop 26 and the beginning of the fabric loop 26' preferably is as small as possible, for example about 10 to 100 mm. A suction box 42' is arranged in the loop of fabric 26' to assist in transferring the web onto the fabric. Additionally, the transfer of the web during initial threading thereof can be aided by a threading table 60 (which can be, for example, an active air foil or the like) for guiding the web from the first fabric onto the second fabric. The threading table 60 preferably is retractable into an inactive position once threading is completed. To remove slack from the web created by the compression in the nip, the second fabric 26' preferably is operated at a higher speed than the first fabric 26.

The invention enables improved softness or silkiness of a creped tissue while at the same time facilitating handling of the tissue paper so that increased machine speeds are attainable. Additionally, compressing of the web enables paper rolls in the reel-up to be wound more densely (i.e., more paper for a given diameter of roll) and reduces the tendency toward telescoping and other roll defects.

The linear nip load in the reel-up preferably is relatively low, and desirably is about 100 to 250 N/m.

Many modifications and other embodiments of the invention will come to mind to one skilled in the art to which this invention pertains having the benefit of the teachings presented in the foregoing descriptions and the associated drawings. As an example, other types of compression devices than those shown can be used. For instance, it is possible to compress the web between two fabrics that each have portions stretched between spaced guide rolls and in contact with each other, whereby tension in the fabrics urges the fabrics against each other to press the web therebetween. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for making a creped tissue paper of enhanced tactile quality and for facilitating handling and control of the tissue in a dry end of a tissue machine, comprising the steps of:

drying a tissue paper web on a heated drying cylinder;

creping the web from the drying cylinder using a creping doctor so as to form a creped tissue paper web;

providing a carrying fabric spaced downstream of the creping doctor, the carrying fabric forming an endless loop about a plurality of guide rolls;

supporting and carrying the web on a web support extending from proximate the creping doctor to the carrying fabric; and carrying the creped tissue paper web on carrying fabric to a reel-up and winding the web from the carrying fabric onto a building paper roll in the reel-up.

2. The method of claim 1, further comprising the step of compressing the web while supported on the carrying fabric so as to substantially reduce the thickness and improve the surface softness of the web.

3. The method of claim 2, wherein the compressing step comprises transporting the creped tissue paper web through a compression device formed by first and second opposed rolls, the first roll being disposed within the loop of the carrying fabric.

4. The method of claim 2, wherein the compressing step comprises transporting the creped tissue paper web through a compression device with the web sandwiched between the carrying fabric and a second fabric such that the web is compressed between the two fabrics, the second fabric being permeable.

5. The method of claim 4, wherein the carrying fabric and second fabric are urged toward each other to compress the web by a roll acting in opposition to a press member, the roll being disposed in the loop of one of the fabrics and the press member being disposed in the loop of the other fabric.

6. The method of claim 5, wherein the press member comprises a roll.

7. The method of claim 4, wherein the carrying fabric is permeable, and further comprising the step of arranging at least one vacuum device against an inward-facing surface of the carrying fabric for urging the web onto the carrying fabric.

8. The method of claim 4, wherein the carrying fabric is impermeable.

9. The method of claim 2, wherein the step of compressing the creped tissue paper web comprises compressing the web to reduce the thickness of the web by about 20 to 50 percent.

10. The method of claim 2, wherein the step of compressing the creped tissue paper web comprises compressing the web between first and second rolls forming a compression nip therebetween, and wherein the web passes through the compression nip with one surface of the web contacting the carrying fabric and the other surface of the web contacting one of the rolls.

11. The method of claim 10, wherein the carrying fabric is permeable, and further comprising arranging a vacuum device against an inward-facing surface of the carrying fabric downstream of the compression nip for ensuring that the web follows the carrying fabric on exiting the nip.

12. The method of claim 2, wherein the step of supporting and carrying the creped tissue paper comprises supporting and carrying the web on a second fabric forming an endless loop about a plurality of guide rolls, said loop of the second fabric having an upstream end proximate the creping doctor, the creped tissue paper being compressed while sandwiched between the carrying fabric and the second fabric, and the web being transferred from the second fabric onto the carrying fabric upstream of the reel-up.

13. The method of claim 12, wherein the carrying fabric is permeable, and further comprising arranging a vacuum device against an inward-facing surface of the carrying fabric downstream of the compression nip for urging the web onto the carrying fabric.

14. The method of claim 13, wherein the second fabric is permeable, and further comprising arranging a vacuum device against an inward-facing surface of the second fabric downstream of the creping doctor for ensuring that the web adheres to the second fabric until the web reaches the carrying fabric.

15. The method of claim 12, wherein the carrying fabric carries the creped, compressed tissue paper along a free-span portion of the carrying fabric that stretches between a pair of spaced guide rolls, and wherein the free-span portion of the carrying fabric forms a reeling nip with the building paper roll in the reel-up.

16. The method of claim 2, wherein the web on the carrying fabric is urged against the building paper roll in a reeling nip, and a peripheral speed of the paper roll is controlled to be up to about 10 percent greater than a speed of the carrying fabric.

17. The method of claim 16, wherein the web is urged against the paper roll by a reeling drum about which the carrying fabric is looped, a peripheral speed of the reeling drum being equal to the speed of the carrying fabric.

18. The method of claim 16, wherein the compression of the web is performed by opposed first and second rolls that form a compression nip through which the web on the carrying fabric is passed, the first roll being within the loop of the carrying fabric and the second roll contacting the web on the carrying fabric, the compression nip substantially reducing the thickness of the web such that slack is created in the web on the carrying fabric, and wherein the second roll is operated at a peripheral speed up to about 20 percent less than that of the first roll such that the second roll reduces slack in the web downstream of the compression nip.

19. The method of claim 2, wherein the web is transported from the creping doctor to the carrying fabric by a second carrying fabric arranged in an endless loop located proximate the drying cylinder, one side of the web contacting the carrying fabric and an opposite side of the web contacting the second carrying fabric.

20. The method of claim 19, wherein a compression roll is arranged to contact the one side of the web and to compress the web on the second carrying fabric, and another compression roll is arranged to contact the opposite side of the web and to compress the web on the carrying fabric.

21. The method of claim 20, wherein each compression roll is operated at a peripheral speed less than a speed of the carrying fabric associated therewith, whereby each compression roll reduces slack in the web downstream thereof.

22. The method of claim 1, wherein the supporting step comprises supporting and carrying the creped tissue paper web on an air foil, an upstream end of the air foil being proximate the creping doctor and a downstream end of the air foil being proximate the carrying fabric such that open draws are substantially avoided between the creping doctor and the carrying fabric.

23. The method of claim 1, wherein the carrying fabric is looped about a reeling drum of the reel-up, the reeling drum forming a reeling nip with the building paper roll and the carrying fabric carrying the creped tissue paper web through the reeling nip.

24. The method of claim 1, wherein the carrying fabric carries the creped tissue paper along a free-span portion of the carrying fabric that stretches between a pair of spaced guide rolls, and wherein the free-span portion of the carrying fabric forms a reeling nip with the building paper roll in the reel-up.

25. The method of claim 1, wherein open draws of the creped tissue paper are substantially avoided by supporting the web at substantially all points from the creping doctor to the reel-up.

26. An apparatus for making a creped tissue of enhanced tactile quality while facilitating handling and control of the web, comprising:

a heated drying cylinder on which a tissue paper is dried;

a creping doctor for creping the tissue paper from the drying cylinder so as to form a creped tissue paper;

a carrying fabric spaced downstream of the creping doctor, the carrying fabric forming an endless loop about a plurality of guide rolls;

a web support extending from proximate the creping doctor to the carrying fabric, the web support supporting and carrying the creped tissue paper thereon; and a reel-up for winding the creped tissue paper onto a building paper roll in the reel-up, the carrying fabric being urged against the building paper roll so as to wind the web thereon.

27. The apparatus of claim 26, further comprising a compression device operable to compress the creped tissue paper while supported on the carrying fabric such that the web is substantially reduced in thickness and its surface softness is improved.

28. The apparatus of claim 27, wherein the reel-up includes a reeling drum and the carrying fabric is looped about the reeling drum, the reeling drum forming a reeling nip with the building paper roll and the carrying fabric carrying the creped tissue paper through the reeling nip.

29. The apparatus of claim 27, wherein the web support comprises an air foil, an upstream end of the air foil being proximate the creping doctor and a downstream end of the air foil being proximate the carrying fabric such that open draws are substantially avoided between the creping doctor and the carrying fabric.

30. The apparatus of claim 27, wherein the compression device comprises a roll and a press member forming a nip therebetween, the carrying fabric passing through the nip with the creped tissue paper thereon.

31. The apparatus of claim 30, wherein the web support comprises a second fabric forming an endless loop about a plurality of guide rolls, said loop of the second fabric having an upstream end proximate the creping doctor, the creped tissue paper being compressed while sandwiched between the carrying fabric and the second fabric, and the web being transferred from the second fabric onto the carrying fabric upstream of the reel-up.

32. The apparatus of claim 31, wherein the carrying fabric is permeable, and further comprising a vacuum device arranged against an inward-facing surface of the carrying fabric for urging the web onto the carrying fabric.

33. The apparatus of claim 32, wherein the second fabric is permeable, and further comprising a vacuum device arranged against an inward-facing surface of the second fabric downstream of the creping doctor for ensuring that the web adheres to the second fabric until the web reaches the carrying fabric.

34. The apparatus of claim 31, wherein the carrying fabric carries the creped, compressed tissue paper along a free-span portion of the carrying fabric that stretches between a pair of spaced guide rolls, and wherein the free-span portion of the carrying fabric forms a reeling nip with the building paper roll in the reel-up.

35. The apparatus of claim 30, wherein the compression device includes a roll and a press member forming a compression nip therebetween, the carrying fabric with the creped tissue paper thereon passing through the compression nip, and wherein at least one of the roll and press member is heated for heating the web in the compression nip.

36. The apparatus of claim 30, wherein the press member comprises a roll.

37. The apparatus of claim 30, wherein the compression device includes the carrying fabric and a second fabric arranged in an endless loop, the creped tissue paper being sandwiched between the carrying fabric and the second fabric and the fabrics being urged toward each other to compress the web, the second fabric being permeable.

38. The apparatus of claim 37, wherein the fabrics are urged toward each other by a roll and a press member, the roll being disposed within the loop of one of the fabrics and the press member being disposed within the loop of the other fabric.

39. The apparatus of claim 37, wherein the carrying fabric is permeable and at least one vacuum device is arranged against an inward-facing surface of the carrying fabric for urging the web onto the carrying fabric.

40. The apparatus of claim 37, wherein the carrying fabric is impermeable.

41. The apparatus of claim 30, wherein the carrying fabric carries the creped, compressed tissue paper along a free-span portion of the loop that stretches between a pair of spaced guide rolls, and wherein the free-span portion of the carrying fabric forms a reeling nip with the building paper roll in the reel-up.

42. The apparatus of claim 30, wherein the compression device comprises a compression roll arranged to contact one side of the web and to compress the web on the carrying fabric.

43. The apparatus of claim 42, wherein the web support comprises a second carrying fabric arranged in an endless loop proximate the drying cylinder, the web being transported on the second carrying fabric with the one side of the web in contact with the second carrying fabric.

44. The apparatus of claim 43, further comprising a second compression roll arranged to contact an opposite side of the web and to compress the web on the second carrying fabric.

* * * * *